US007826753B2

(12) United States Patent
Watanabe

(10) Patent No.: US 7,826,753 B2
(45) Date of Patent: Nov. 2, 2010

(54) IMAGE FORMING APPARATUS WITH AN ANTENNA PORTION

(75) Inventor: Yasunori Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 680 days.

(21) Appl. No.: 11/765,050

(22) Filed: Jun. 19, 2007

(65) Prior Publication Data

US 2008/0012771 A1 Jan. 17, 2008

(30) Foreign Application Priority Data

Jun. 30, 2006 (JP) ..... 2006-181771

(51) Int. Cl.
*G03G 15/00* (2006.01)

(52) U.S. Cl. ..... 399/1

(58) Field of Classification Search ..... 399/1, 399/107, 411

See application file for complete search history.

(56) References Cited

U.S. PATENT DOCUMENTS 5,570,159 A * 10/1996 Hirose et al. ..... 399/107
2004/0082309 A1* 4/2004 Smith ..... 455/344
2004/0130700 A1* 7/2004 Ogi et al. ..... 355/133
2006/0067734 A1 3/2006 Igarashi et al.
2006/0088333 A1* 4/2006 Watanabe et al. ..... 399/107

FOREIGN PATENT DOCUMENTS

JP 2003280313 A * 10/2003
JP 2006053477 2/2006
JP 2006-056017 A 3/2006
JP 2006-098772 A 4/2006

OTHER PUBLICATIONS

JP Office Action dtd Apr. 15, 2008, JP App 2006-181771.
U.S. Appl. No. 11/758,110, filed Jun. 5, 2007.
U.S. Appl. No. 11/758,129, filed Jun. 5, 2007.

* cited by examiner

*Primary Examiner*—David M Gray
*Assistant Examiner*—G. M. Hyder
(74) *Attorney, Agent, or Firm*—Banner & Witcoff, Ltd.

(57) ABSTRACT

An image forming apparatus includes: a first metal side plate; a second metal side plate opposed to the first metal side plate; an exposure unit disposed between the first and second metal side plates; an antenna; and a metal top plate disposed between the first and second metal side plates and between the antenna and the exposure unit.

6 Claims, 10 Drawing Sheets

IMAGE FORMING APPARATUS WITH AN ANTENNA PORTION

CROSS-REFERENCE TO RELATED APPLICATIONS

This application is based upon and claims the benefit of priority from Japanese Patent Application No. 2006-181771, filed on Jun. 30, 2006, the entire contents of which are incorporated herein by reference.

TECHNICAL FIELD

The present invention relates to an image forming apparatus equipped with an antenna portion for radio communication.

BACKGROUND

An electrophotographic image forming apparatus, such as a laser printer and a copying machine forms an electrostatic latent image on a photoconductor such as a photoconductive drum by exposing the photoconductor by an exposure unit (scanner), electrostatically adheres a developer onto the electrostatic latent image, and then transfers the adhered developer from the photoconductor onto a recording sheet such as a paper to form an image on the recording sheet.

In general, data of the image to be formed by the image forming apparatus are transmitted from a device such as a computer connected to the image forming apparatus. Recently, a radio communication is widely used to connect the image forming apparatus to the computer. JP-A-2006-53477 discloses an antenna portion disposed on an upper surface side of an image forming apparatus to enable a radio communication between the image forming apparatus and a computer.

The antenna portion disposed on the upper side of the image forming apparatus enables a satisfactory radio communication almost omni-directionally throughout 360°. However, because the antenna portion transmits and receives an electromagnetic wave for radio communication, the electromagnetic wave radiated from the antenna portion may adversely affect an operation of an exposure unit. The adverse effect on the exposure unit operation degrades the quality of an image formed on a recording sheet because an electrostatic latent image cannot be accurately formed on a photoconductor by exposure of the exposure unit.

The present invention has been made in view of the above circumstances.

SUMMARY

According to an aspect of the invention, there is provided an image forming apparatus which includes: an image forming portion including a photoconductor that carries a developer image to be transferred onto a recording sheet, and an exposure unit that exposes the photoconductor; a first side plate portion and a second side plate portion arranged on respective sides of the image forming portion in a horizontal direction to oppose to each other, the first and second side plates supporting the image forming portion and extending in a substantially vertical direction; a metal top plate portion fixed to the first side plate portion and the second side plate portion so that the top plate portion extends in the horizontal direction to connect an upper end side of the first side plate portion and an upper end side of the second side plate portion and covers an upper side of the exposure unit; and an antenna portion for radio communication, disposed on a top side of the top plate portion. The first side plate portion and the second side plate portion are constructed to have metal plates, respectively.

According to another aspect of the invention, there is provided an image forming apparatus including: a first metal side plate; a second metal side plate opposed to the first metal side plate; an exposure unit disposed between the first and second metal side plates; an antenna; and a metal top plate disposed between the first and second metal side plates and between the antenna and the exposure unit.

DESCRIPTION

A laser printer 1, which is an example of an image forming apparatus according to the present invention, will be discussed with reference to the accompanying drawings.

Figure 1:
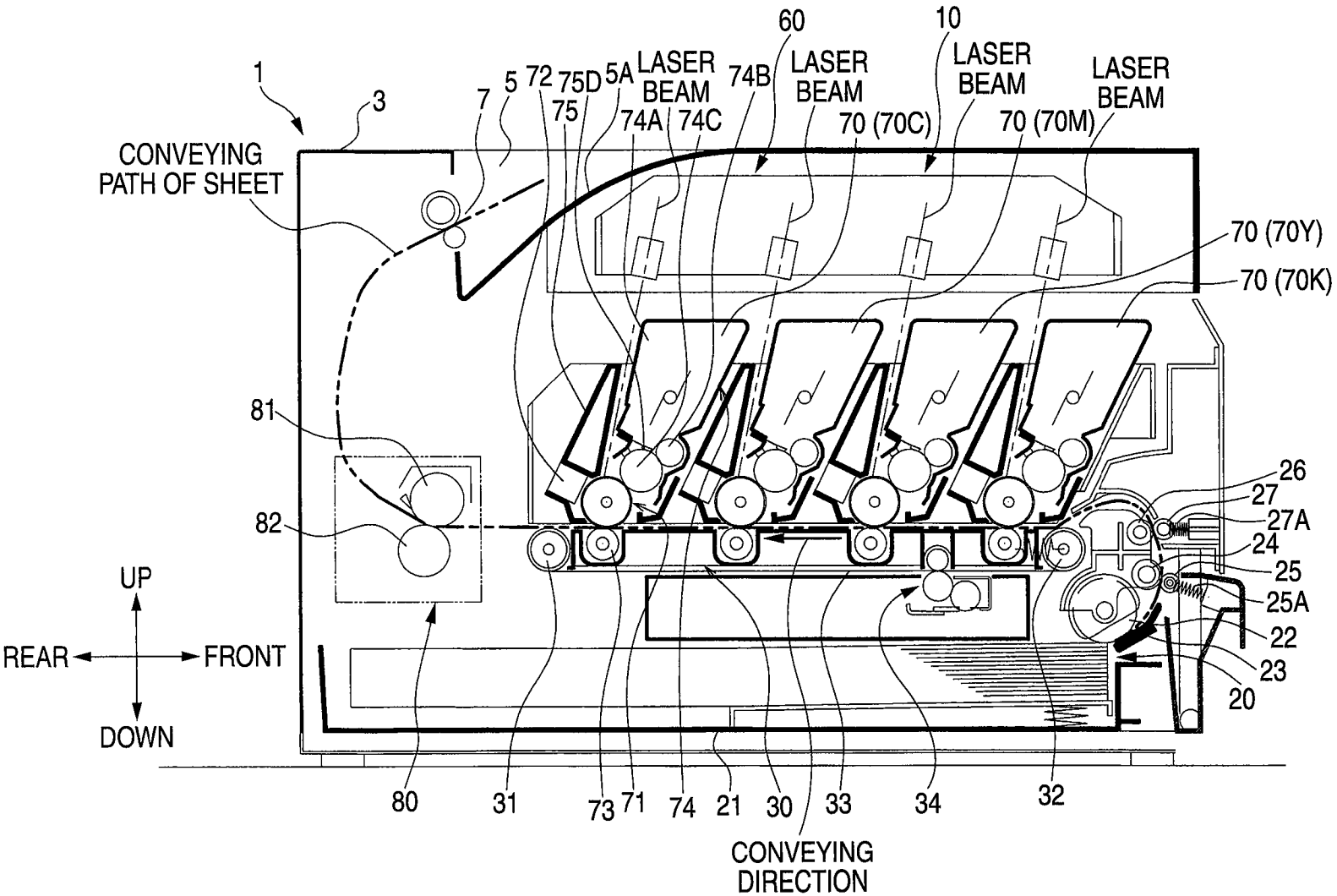
FIG. 1 is a side sectional view showing a main portion of the laser printer 1.
Figure 2:
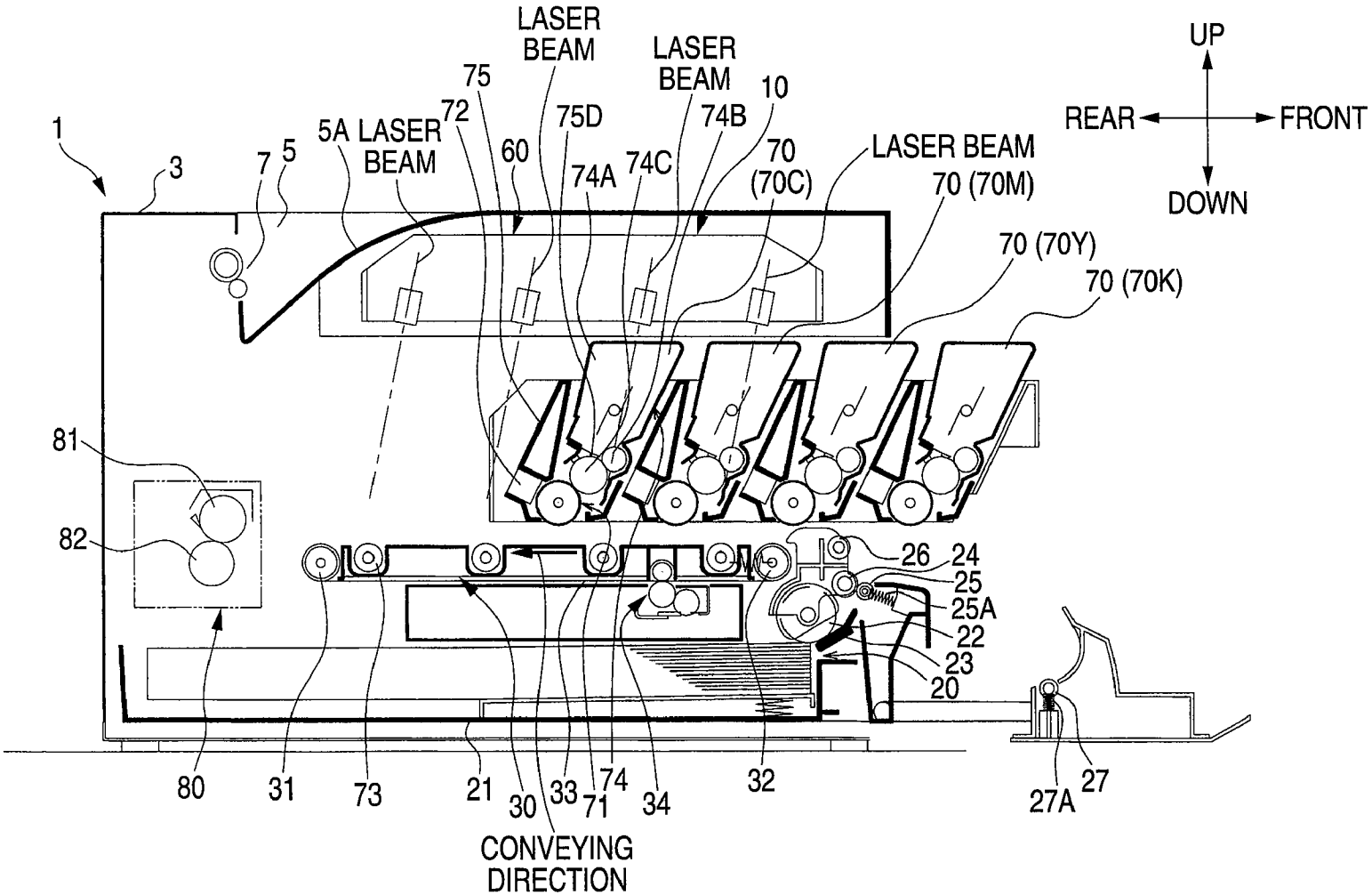
FIG. 2 is a side sectional view for explaining how process cartridges 70 are attached to and detached from the laser printer 1.
Figure 3:
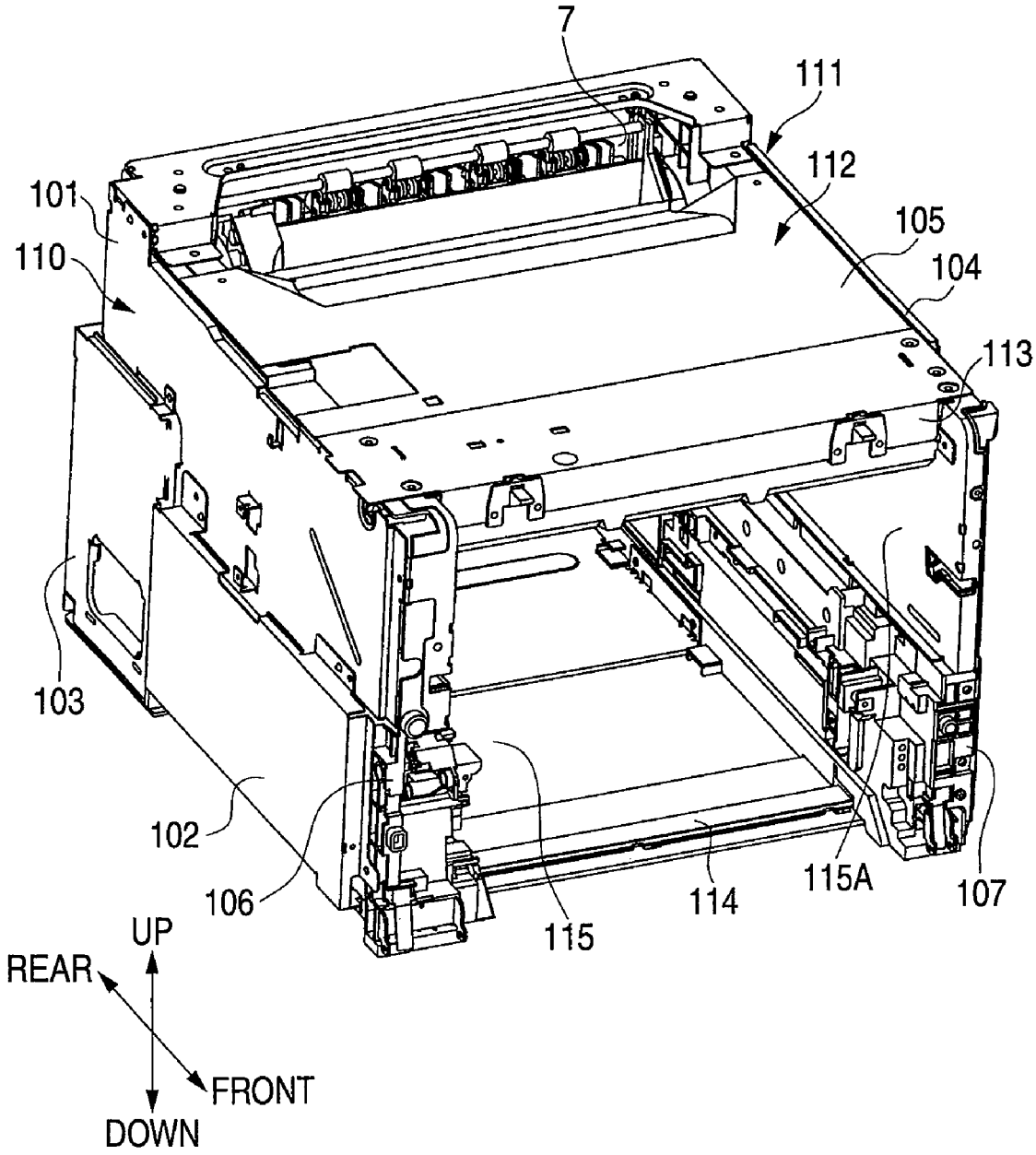
FIG. 3 is a left perspective view showing a frame structure of the laser printer 1.
Figure 4:
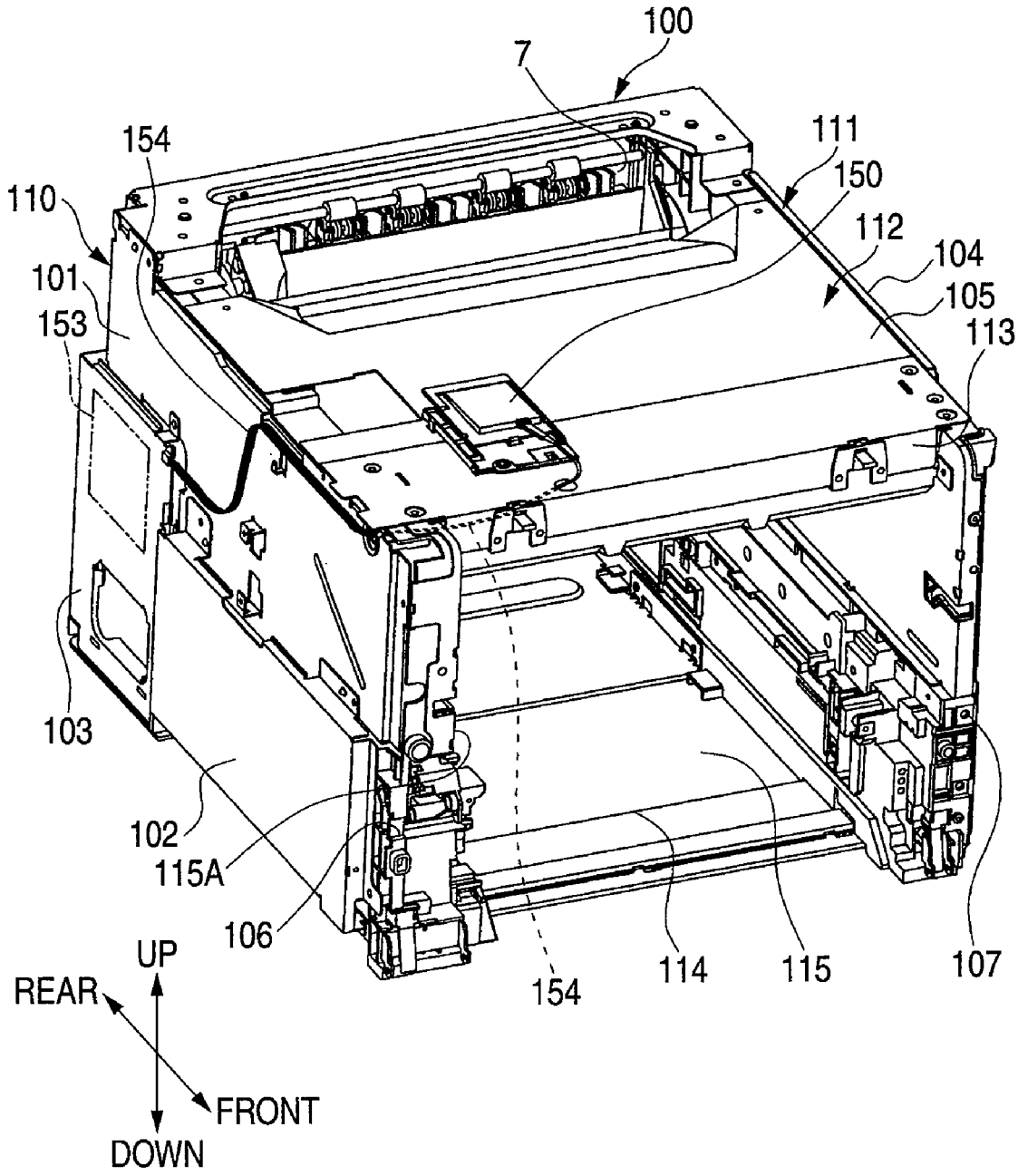
FIG. 4 is a view showing a state in which an antenna portion 150 is mounted to the frame structure shown in FIG. 3.
Figure 5:
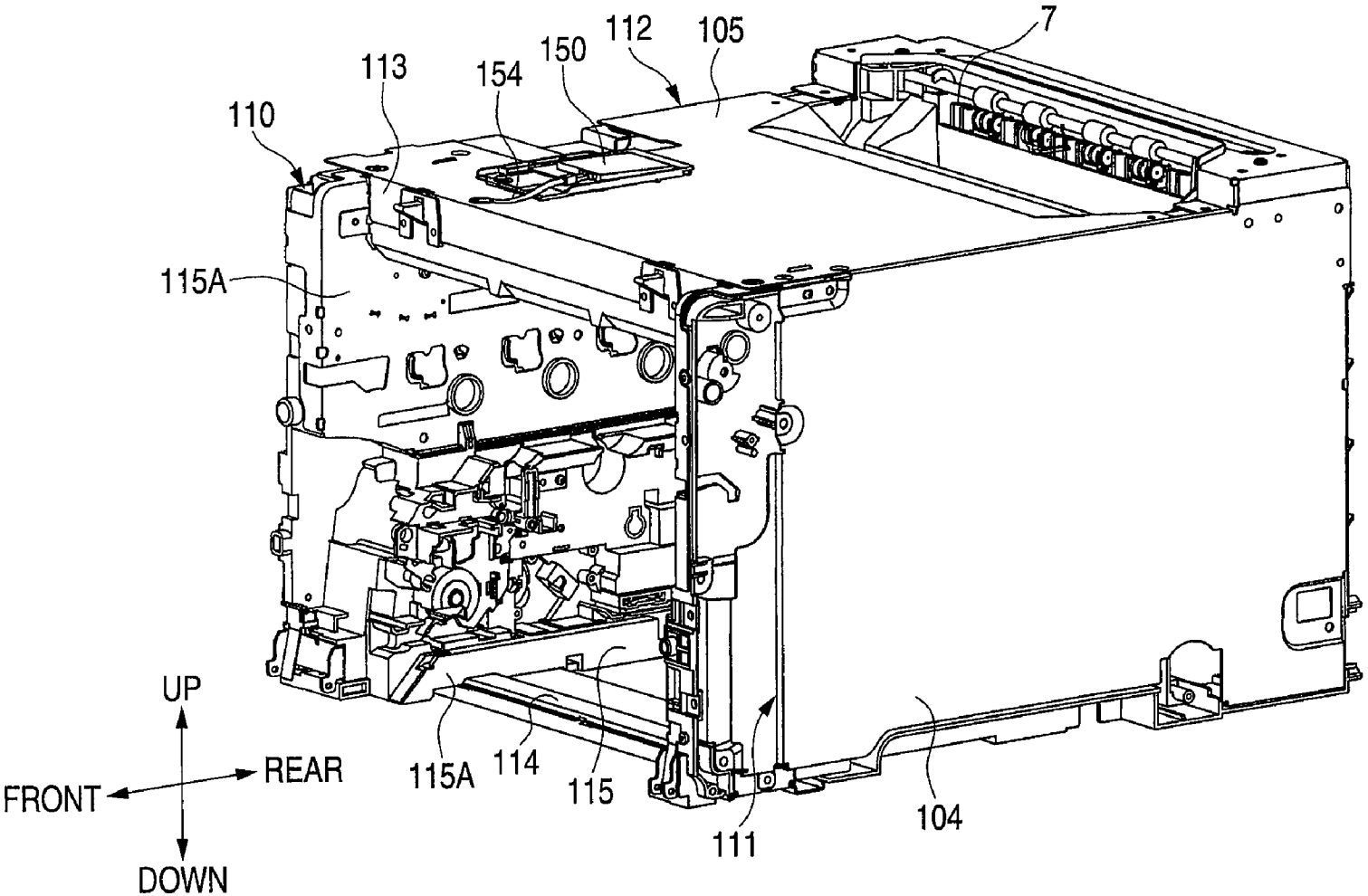
FIG. 5 is a right perspective view showing the frame structure of the laser printer 1.

FIG. 1 is a side sectional view showing a main portion of the laser printer 1, FIG. 2 is a side sectional view for explaining how process cartridges 70 are attached to and detached from the laser printer 1, FIG. 3 is a left perspective view showing a frame structure of the laser printer 1, FIG. 4 is a view showing a state in which an antenna portion 150 is mounted to the frame structure shown in FIG. 3, and FIG. 5 is a right perspective view showing the frame structure of the laser printer 1.

Figure 6:
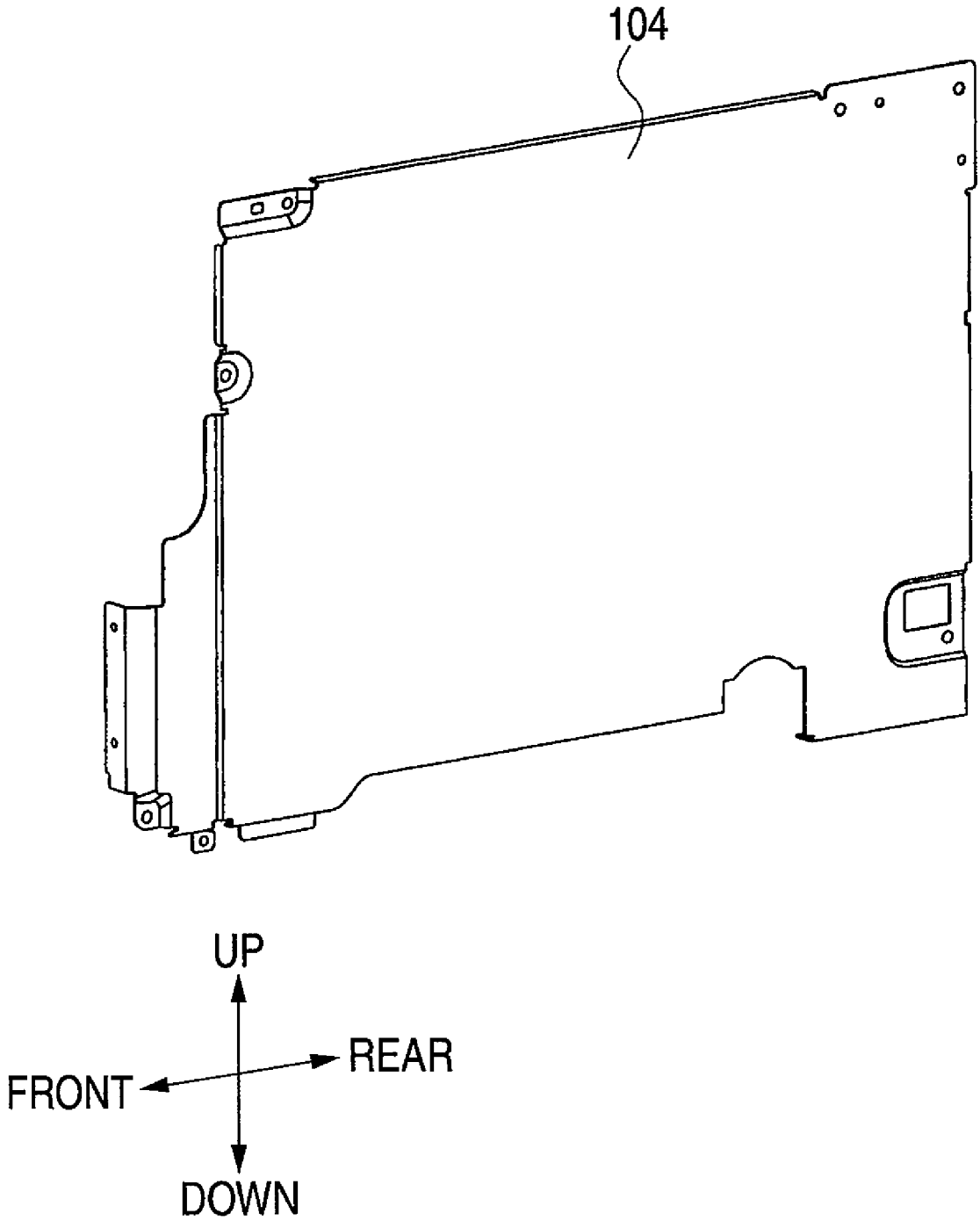
FIG. 6 is a perspective view of a fourth plate 104.
Figure 7:
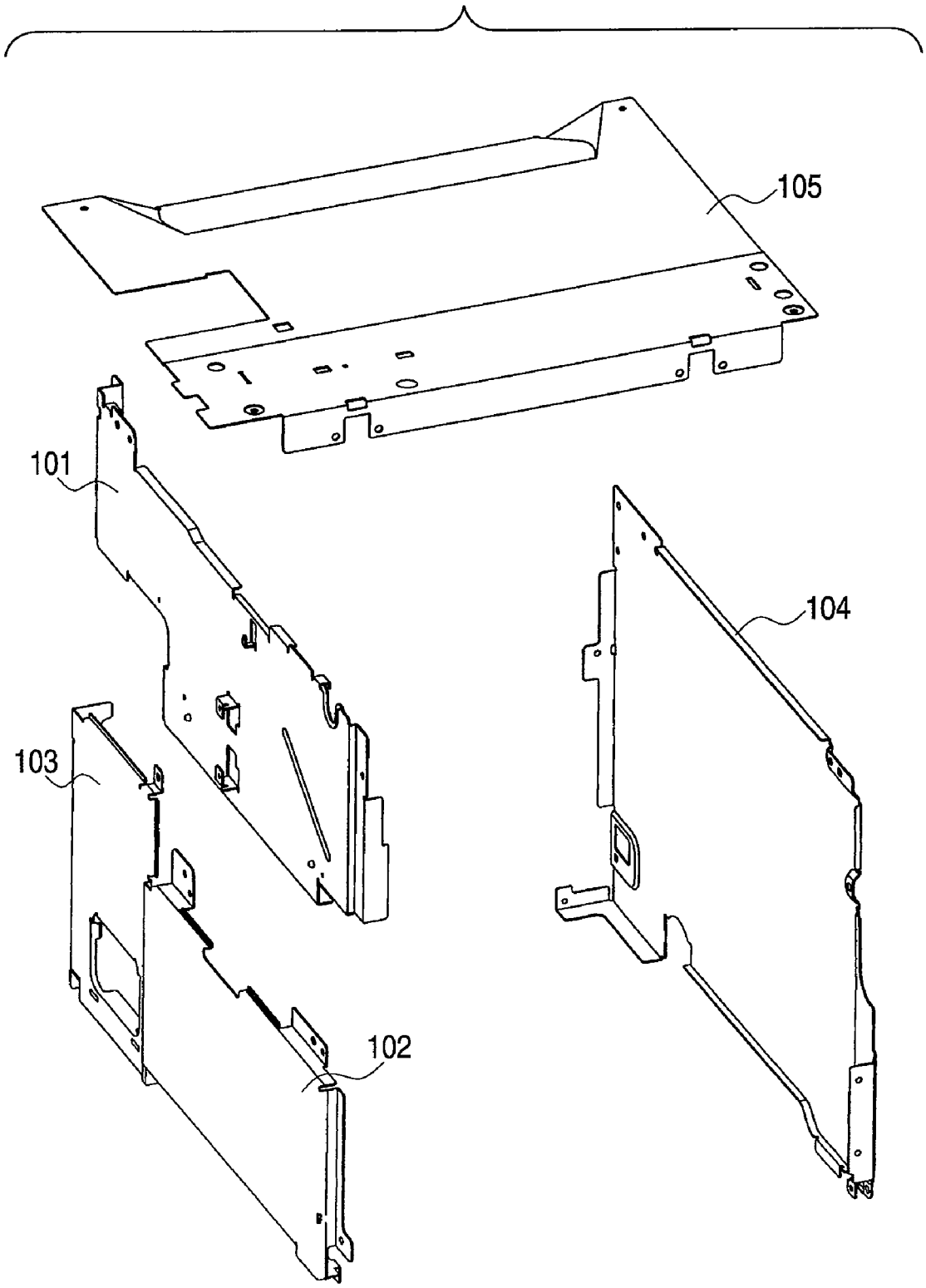
FIG. 7 is a perspective view of first to fifth plates 101 to 105.
Figure 8:
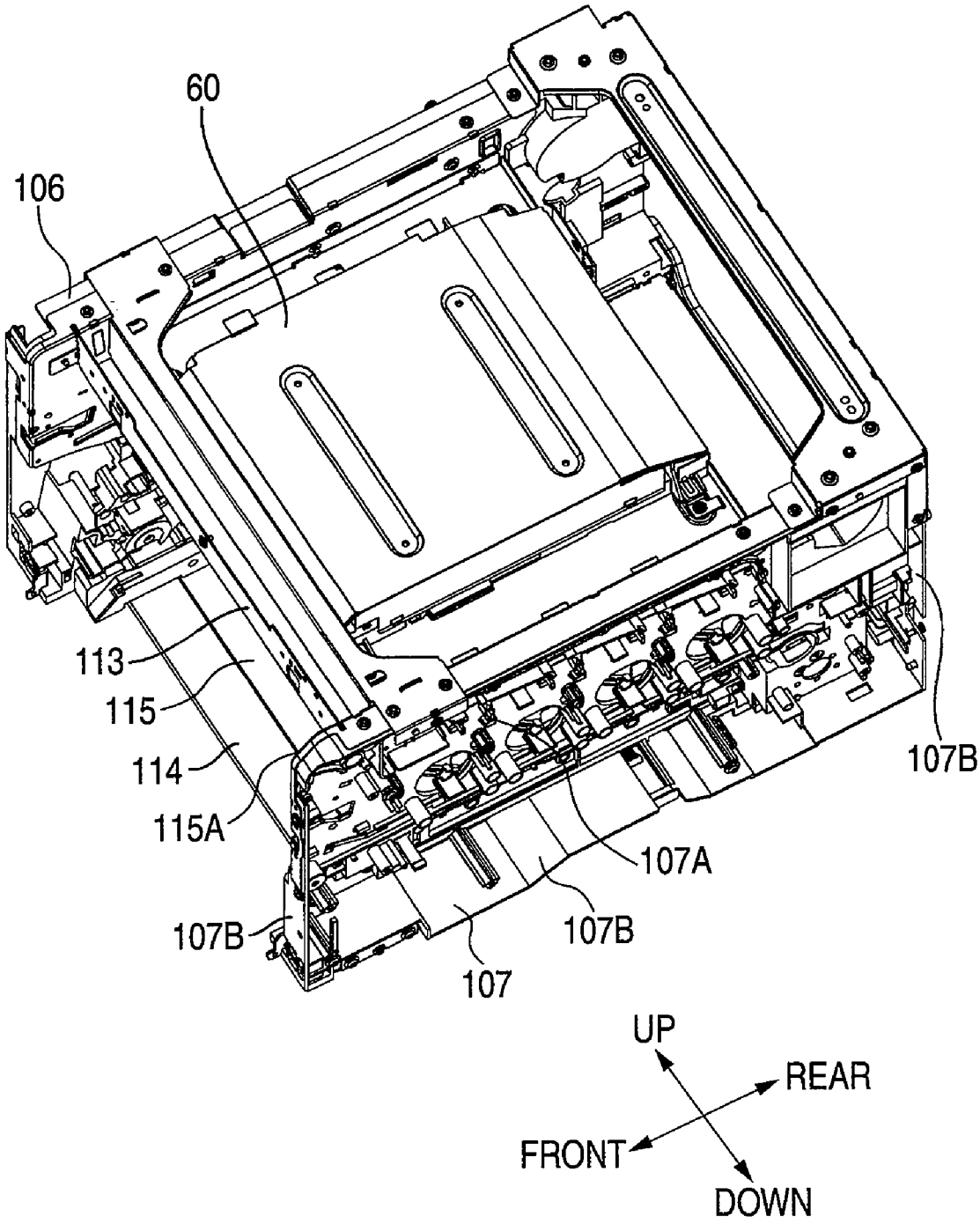
FIG. 8 is an upper perspective view showing a state in which the fifth plate 105 is removed.
Figure 9:
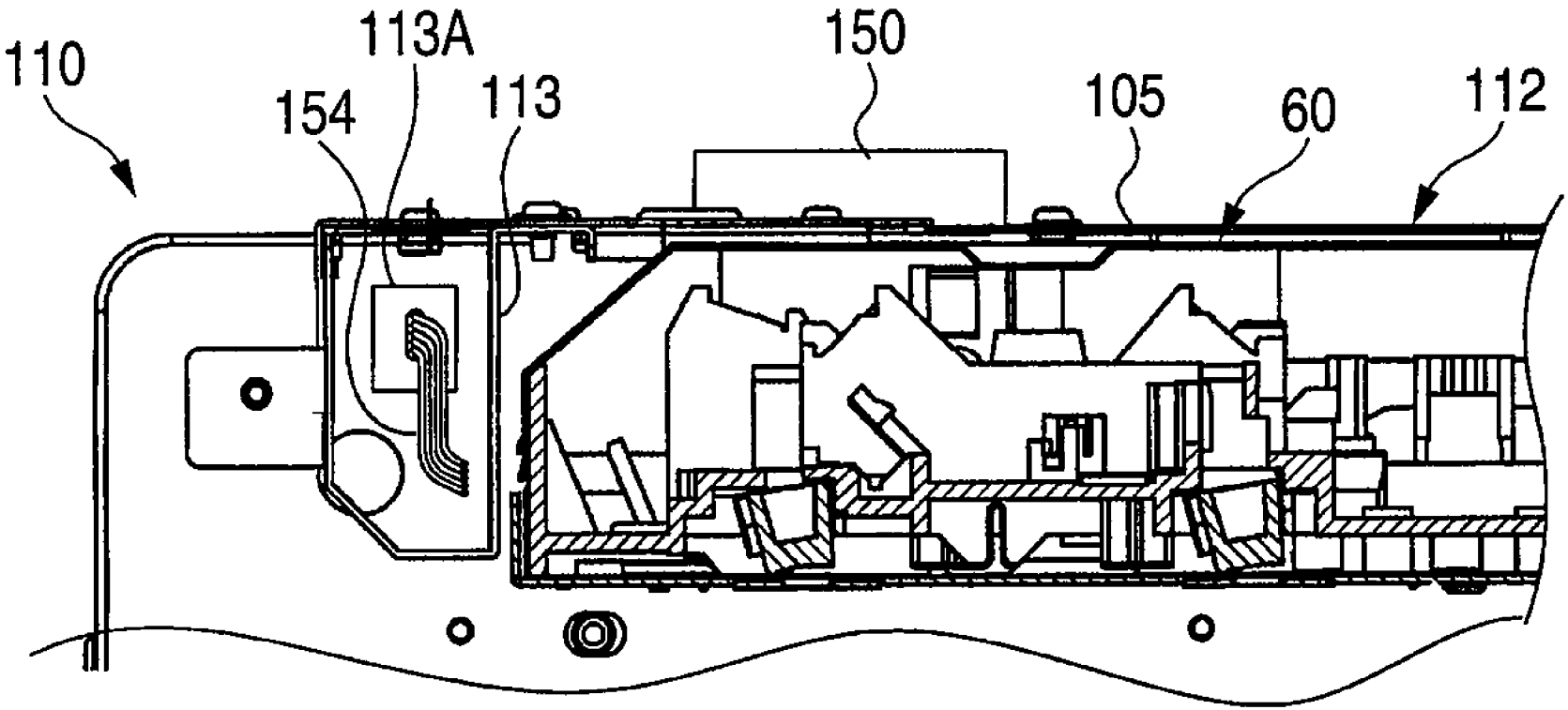
FIG. 9 is an enlarged sectional view of a reinforcing member 113.
Figure 10:
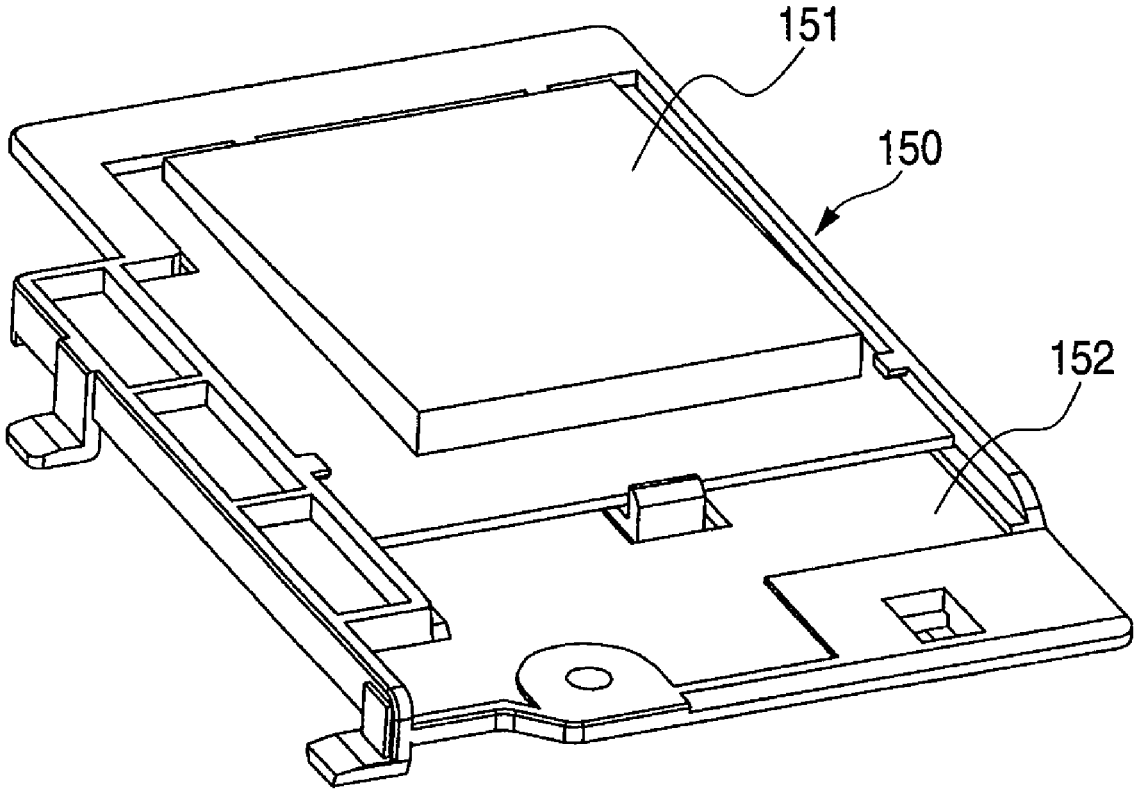
FIG. 10 is an enlarged perspective view of the antenna portion 150.

FIG. 6 is a perspective view of a fourth plate 104, FIG. 7 is a perspective view of first to fifth plates 101 to 105, FIG. 8 is an upper perspective view showing a state in which the fifth plate 105 is removed, FIG. 9 is an enlarged sectional view of a reinforcing member 113, and FIG. 10 is an enlarged perspective view of the antenna portion 150.

FIG. 1 to FIG. 10 illustrates the laser printer 1 with main portions emphasized to facilitate the understanding of features of the laser printer 1, and therefore the laser printer 1 shown in FIG. 1 to FIG. 10 is slightly different in details from an actual laser printer.

1. External Configuration of Laser Printer

In a normal use, the laser printer 1 is oriented and set such that the upper side of FIG. 1 corresponds to the upper side in the gravity direction and the right side of FIG. 1 corresponds to the front side.

A housing 3 of the laser printer 1 is shaped into an almost box form (cubic form), and the upper surface side of the housing 3 is provided with a discharge tray 5 on which a paper sheet, an OHP sheet or the like (simply referred to as a "sheet" hereinafter) is placed after the sheet is printed and discharged from the housing 3.

The discharge tray 5 has an inclined surface 5A which is inclined downward from the upper surface of the housing 3 as it goes rearward. A discharge portion 7 from which the printed sheet is discharged is provided at the rear end side of the inclined surface 5A.

A frame member 100 is provided inside the housing 3. The frame member 100 includes first to fifth plates 101 to 105 made of metal and first and second frames 106, 107 made of resin. A process cartridge 70, a fixing unit 80, etc., described later, are attached detachably to the frame member 100.

2. Internal Configuration of Laser Printer (see FIG. 1)

An image forming portion 10 constitutes an image forming means for forming an image on the sheet, and includes four process cartridges 70K, 70Y, 70M, 70C. A feeder portion 20 constitutes a part of conveying means for supplying the sheet to the image forming portion 10. A conveying mechanism 30 also constitutes a part of the conveying means and serves to convey the sheet to the four process cartridges 70K, 70Y, 70M, 70C.

The conveying direction of the sheet on which an image formation by the image forming portion 10 is complete is turned toward the upper direction by a discharge chute (not shown), and then the sheet is discharged from the discharge portion 7 to the discharge tray 5.

2.1 Feeder Portion

The feeder portion 20 includes: a sheet tray 21 installed into the lowermost portion of the housing 3 to accommodate a stack of the sheets; a feed roller 22 provided at the upper side in front of a front end portion of the sheet tray 21 to feed (convey) the sheet from the stack on the sheet tray 21 to the image forming portion 10; and a separating pad provided at a location facing the feed roller 22 to separate the sheet one by one from the stack by applying a predetermined conveyance resistance to the sheet.

The sheet on the sheet tray 21 is conveyed to the image forming portion 10 disposed substantially at a center portion in an interior of the housing 3 after the sheet is U-turned at the front side in the interior of the housing 3. To this end, a sheet conveying path extending from the sheet tray 21 to the image forming portion 10 has a substantially U-shaped curved portion in which a conveying roller 24 is provided to apply a conveying force to the sheet conveyed, while being bent into a U-shape, to the image forming portion 10.

A pressurize roller 25 for pressing the sheet against the carry roller 24 is provided at a location in which the sheet is interposed between the conveying roller 24 and the pressurize roller 25. The pressurize roller 25 is urged toward the conveying roller 24 by an elastic means such as a coil spring 25A.

A registration roller 26 and a registration rolling element 27 opposing the registration roller 26 are provided in the downstream side of the conveying roller 24 in the sheet conveying direction. The registration roller 26 contacts a leading end of the sheet being conveyed by the conveying roller 24 to correct a skew of the sheet, and then conveys the sheet further toward the image forming portion 10. The registration rolling element 27 is urged toward the registration roller 26 by an elastic means such as a coil spring 27A.

2.2 Conveying Mechanism

The conveying mechanism 30 includes: a driving roller 31 rotated in linking with an operation of the image forming portion 10; a follower roller 32 rotatably disposed at a location spaced apart from the driving roller 31; and a conveying belt 33 suspended between the driving roller 31 and the follower roller 32.

When the conveying belt 33 with the sheet put thereon is rotated, the sheet conveyed from the sheet tray 21 is conveyed to the four process cartridges 70K, 70Y, 70M, 70C sequentially.

A belt cleaner 34 serves as a erasing means for erasing (removing) a registration image formed, for correction, on a surface of the conveying belt 33. After the correction to control the operation of the image forming portion 10 is ended, the registration image formed on the conveying belt 33 is erased by the belt cleaner 34.

2.3 Image Forming Portion

The image forming portion 10 includes a scanner portion 60, the process cartridge 70 and a fixing unit 80. The image forming portion 10 in this example employs a so-called direct tandem system to execute color printing.

In this example, the four process cartridges 70K, 70Y, 70M, 70C are arranged along the sheet conveying direction. More specifically, the four process cartridges 70K, 70Y, 70M, 70C respectively corresponding to four color developers (toners) of black, yellow, magenta, and cyan are aligned in series from the upstream side in the sheet conveying direction.

The structures of the four process cartridges 70K, 70Y, 70M, 70C are basically the same with the exception of color of the developer stored therein. Therefore, those four process cartridges 70K, 70Y, 70M, 70C may be collectively referred to as the process cartridge 70 when applicable.

2.3.1 Scanner Portion

A scanner portion 60 is disposed in the upper area of the interior of the housing 3 to form an electrostatic latent image on a surface of each of photoconductive drums 71 provided to four process cartridges 70K, 70Y, 70M, 70C respectively. The scanner portion 60 includes laser light sources, polygon mirrors, an fθ lenses, and reflecting mirrors.

The laser beam emitted from the laser light source based on image data is deflected by the polygon mirror to pass through the fθ lens, and then an optical path of the laser beam is turned back by the reflecting mirror. Then, the optical path is further directed downward by the reflecting mirror, and then the laser beam is irradiated onto the surface of the photoconductive drum 71, to thereby form the electrostatic latent image on the surface of the photoconductive drum 71.

2.3.2 Process Cartridge

Because the four process cartridges 70K, 70Y, 70M, 70C are basically identical in structure to each other with the exception of the color of the developer, the structures of those cartridges will be explained by taking the process cartridge 70C as an example.

The process cartridge 70C is detachably disposed in the interior of the housing 3 under the scanner portion 60. The process cartridge 70C has a process casing 75 that houses the photoconductive drum 71, a charger 72, a developer cartridge (toner cartridge) 74, and the like therein. A transfer roller 73 is supported rotatably by the frame member 100 on the opposite side to the photoconductive drum 71 such that the conveying belt 33 is interposed between the photoconductive drum 71 and the transfer roller 73.

Four process cartridges 70K, 70Y, 70M, 70C can be attached to and detached from the frame member 100, i.e., the laser printer 1, by moving the process casing 75 in the sheet conveying direction (lateral direction) as shown in FIG. 2.

The photoconductive drum 71 serves as an image carrying means for carrying an image to be transferred onto the sheet. The photoconductive drum 71 has a cylindrical shape, the outermost layer of which is formed by a positively chargeable photoconductive layer made of polycarbonate or the like.

The charger 72 serves as a charging means for charging the surface of the photoconductive drum 71. The charger 72 is provided in the obliquely upper rear side of the photoconductive drum 71 such that the charger 72 is opposed to the photoconductive drum 71 at a predetermined gap so as not to contact the photoconductive drum 71.

As the charger 72 in this example, a scolotron type charger is employed, which discharges a corona from a charging wire made of tungsten, or the like to positively electrify the surface of the photoconductive drum 71 substantially uniformly.

The transfer roller 73 is disposed to oppose to the photoconductive drum 71 and is rotated in linking with the rotation of the photoconductive drum 71. The transfer roller 73 serves as a transferring means that transfers the developer adhered on the surface of the photoconductive drum 71 onto a printing surface of the sheet by applying an opposite charge to the sheet. That is, the charge opposite the charge of the photoconductive drum 71 (a negative charge in this example) is applied by the transfer roller 73 to the sheet from the opposite side to the printing surface when the sheet passes through the vicinity of the photoconductive drum 71.

The developer cartridge 74 includes a developer container 74A in which the developer is contained, a developer supply roller 74B for supplying the developer to the photoconductive drum 71 and a develop roller 74C.

The developer contained in the developer container 74A is supplied to the develop roller 74C by rotation of the developer supply roller 74B. The developer thus supplied to the develop roller 74C is carried on a surface of the develop roller 74C with the thickness of the carried developer being adjusted to a predetermined constant (uniform) thickness by a layer thickness restricting blade 74D. Thereafter, the carried developer is supplied to the surface of the photoconductive drum 71 exposed by the scanner portion 60.

2.3.3 Fixing Unit

The fixing unit 80 is arranged on the downstream side of the photoconductive drum 71 in the sheet conveying direction, and heats/fuses the developer transferred onto the sheet to fix thereon. This fixing unit 80 is assembled to the frame member 100.

The fixing unit 80 includes: a heat roller 81, disposed in a side in which the printing surface of the sheet is faced, for applying a conveying force to the sheet while heating the developer; and a pressurize roller 82, disposed in the opposite side to the heat roller 81 with the sheet interposed therebetween, push the sheet toward the heat roller 81.

The heat roller 81 is driven by a driving means (not shown) such as a motor, and the pressurize roller 82 is rotated dependently by a rotating force received from the heat roller 81 via the sheet.

2.3.4 Outline of Image Forming Operation

The image forming portion 10 forms an image on the sheet as follows.

The surface of the photoconductive drum 71 is positively charged uniformly by the charger 72 while being rotated, and then is exposed by a high-speed scanning of the laser beam irradiated from the scanner portion 60. Accordingly, the electrostatic latent image corresponding to the image to be formed on the sheet is formed on the surface of the photoconductive drum 71.

Then, when the developer carried on the develop roller 74C and charged positively is brought into contact with the photoconductive drum 71 by a rotation of the develop roller 74C, the developer is supplied to the electrostatic latent image formed on the surface of the photoconductive drum 71, i.e., the exposed portion which is exposed by the laser beam and thus lowered in an electric potential than the uniformly charged surface of the photoconductive drum 71. Consequently, the electrostatic latent image on the photoconductive drum 71 is made visible and the toner image obtained by the reversal development is carried on the surface of the photoconductive drum 71.

Thereafter, the toner image carried on the surface of the photoconductive drum 71 is transferred onto the sheet by a transferring bias applied to the transfer roller 73. Then, the sheet onto which the toner image is transferred is conveyed to the fixing unit 80 where the developer transferred as the toner image is heated and fixed to the sheet, whereby the image formation is completed.

2.4 Frame Member

The frame member 100 includes first to fifth plates 101 to 105 made of a metal such as SPCC (cold rolled carbon steel sheets) shown in FIG. 7 and first and second frames 106, 107 made of a resin such as PC, ABS and polymer alloy, which is excellent in mechanical strength, shown in FIG. 8. The first to fifth plates 101 to 105 are indirectly joined and fixed mutually via the first and second frames 106, 107.

As shown in FIG. 8, the second frame 107 is in the form of a tray including a rectangular plate-like frame main body 107A and a wall portion 107B, which is integrally formed together with the frame main body portion 107A to project from an outer peripheral portion of the frame main body 107A in a direction perpendicular to the frame main body 107A. The first frame 106 is in the form of a tray similarly to the second frame 107.

The first frame 106 and the second frame 107 are arranged to oppose to each other in the horizontal direction such that the image forming portion 10 including the scanner portion 60 is disposed therebetween. As shown in FIG. 3, the first, second and third plates 101, 102 103 are assembled and fixed to the first frame 106 by fastening means such as P screws, and the fourth plate 104 is assembled and fixed to the second frame 107 by fastening means such as P screws.

The first frame 106 to which the first to third plates 101 to 103 are fixed is called a first side plate portion 110 hereinafter. Also, the second frame 107 to which the fourth plate 104 is fixed is called a second side plate portion 111 hereinafter.

The first plate 101 covers gears (not shown) that transmit a power to the transfer roller 73 and the like. The second plate 102 covers an engine control board (not shown) to control an electric motor (not shown) that rotates and drives the photoconductive drum 71, the transfer roller 73 and the like. The third plate 103 covers a main control board (not shown) that controls the overall laser printer 1. The fourth plate 104 covers the second frame 107.

The fifth plate 105 is fixed to the first side plate portion 110 and the second side plate portion 111 to extend between the upper end side of the first side plate portion 110 and the upper end side of the second side plate portion 111 in the horizontal direction. As shown in FIG. 8 and FIG. 9, a reinforcing member 113 is assembled and fixed to the first side plate portion 110 and the second side plate portion 111 at the front side of the laser printer 1 by fastening means such as screws to extend between the first side plate portion 110 and the second side plate portions 111 in the horizontal direction.

A sectional shape of the reinforcing member 113 in the direction perpendicular to the longitudinal direction is formed into a substantially U-shape to enhance a flexural rigidity in the direction perpendicular to the longitudinal direction. The first side plate portion 110 and the second side plate portion 111 are firmly joined and fixed to each other by the reinforcing member 113 and the fifth plate 105. The reinforcing member 113 and the fifth plate 105 may be collectively referred to as a top plate portion 112 when applicable.

The reinforcing member 113 is made of metal such as SPCC and is assembled to the upper end sides of the first side plate portion 110 and the second side plate portion 111 such that the opening portion of the substantially U-shaped section is directed upward. Each of the reinforcing member 113 and the fifth plate 105 is fixed to the first frame 106 and the second frame 107, and thus indirectly joined and fixed to the first plate 101 and the fourth plate 104.

As shown in FIG. 3 and FIG. 4, lower end sides of the first side plate portion 110 and the second side plate portion 111 are joined to a bottom frame 114 made of a metal such as SPCC. The process cartridge 70 including the developer cartridge 74 73 is detachably assembled via the process casing 75 into a space 115 that is rectangular in section and that is surrounded by the first and second side plate portions 110, 111, the top plate portion 112, and the bottom frame 114 and that extend in the front-to-rear direction of the laser printer 1. The process casing 75 (the developer cartridge 74) can be attached to and detached from the laser printer 1 through an attachment/detachment port 115A provided at the front end of the space 115.

As shown in FIG. 4 and FIG. 5, the upper side of the scanner portion 60 and the opening portion side of the reinforcing member 113 are covered with the fifth plate 105. An antenna portion 150 for radio communication is disposed on the upper surface of the fifth plate 105 at a location which is offset toward the first side plate 110 from the center between the first and second side plate portions 110, 111.

As shown in FIG. 10, the antenna portion 150 includes an antenna main body 151 for transmitting/receiving an electromagnetic wave and a pedestal plate 152 for assembling and fixing the antenna main body 151 to the top plate portion 112. As shown in FIG. 4, the antenna portion 150 is connected via an antenna cable 154 to a signal processing board 153 disposed on the first side plate portion 110.

The signal processing board 153 serves as a signal processing means for processing a radio signal. The signal processing board 153 is provided on the main control board.

As shown in FIG. 4, a part of the antenna cable 154, which extends from the antenna portion 150 to the first side plate portion 110, is substantially accommodated within an internal space defined by the U-shaped section of the reinforcing member 113. Apart of the antenna cable 154, which extends from a hole 113A (see also FIG. 9) of the first side plate portion 110 to the signal processing board 153, is disposed along the outer side surface of the first plate 101 so that the first side plate portion 110 (the first plate 101 and the first frame 106) is interposed between the part of the antenna cable 154 and the scanner portion 60.

3. Features of Laser Printer

As shown in FIG. 3 and FIG. 4, the scanner portion 60 is surrounded, at its three sides, by the first and second side plate portions 110, 111 having the first to fifth metal plates 101 to 105, and the metal top plate portion 112. Therefore, the electromagnetic wave (electrical noise) radiated from the antenna portion 150 is shielded with the first and second side plate portions 110, 111 and the top plate portion 112, and is prevented from arriving at the scanner portion 60.

The first to fifth plates 101 to 105 is grounded via a power supply circuit (not shown) when a power supply of the laser printer 1 is connected to a commercial or house plug socket. Therefore, the electromagnetic wave shielded with the first and second side plate portions 110, 111 and the top plate portion 112 is discharged via the power supply circuit to the ground.

The antenna portion 150 is provided at the top side of the top plate portion 112. Therefore, the first and second side plate portions 110, 111 and the top plate portion 112 do not interfere radio communication and thus the radio communication can be satisfactorily established substantially omni-directionally throughout 360°.

Consequently, the good radio communication can be held substantially omni-directionally throughout 360° while remarkably reducing the adverse influence on the operation of the scanner portion 60 by the electromagnetic wave radiated from the antenna portion 150.

When a large external force acts on the image forming portion 10 such as the scanner portion 60, the image forming portion 10 is mechanically distorted to degrade the quality of the image formed on the sheet.

In the laser printer 1, a gate-like frame high in mechanical strength (rigidity) is constructed by fixing the first and second side plate portions 110, 111 having the first to fifth metal plates 101 to 105 and the top plate portion 112, and further the image forming portion 10 is supported by this gate-like frame (the first and second side plate portions 110, 111). Therefore, even when a large external force acts on the laser printer 1, the external force can be received by the gate-like frame that is constructed by the first and second side plate portions 110, 111 and the top plate portion 112.

Consequently, the mechanical distortion on the image forming portion 10 can be suppressed, and thus the degrade of the image quality can be eliminated.

The gate-like frame of the high mechanical strength in the laser printer 1 can be used not only to eliminate the mechanical distortion but also to establish the excellent radio communication throughout 360° and to reduce the adverse influence of the electromagnetic wave on the scanner portion (60) operation.

A part of the antenna cable 154, which extends from the antenna portion 150 to the first side plate portion 110, is accommodated within the internal space defined by the U-shaped section of the reinforcing member 113. A part of the antenna cable 154, which extends further from first side plate portion 110 to the signal processing board 153 is disposed along the side surface of the first plate 110 so that the first side plate portion 110 is interposed between the scanner portion 60 and the part of the antenna cable 154. Therefore, although the electrical noise (the electromagnetic wave) may be leaked from the antenna cable 154, such electronic noise can be shielded with the first side plate portion 110 (the first plate 101) and the top plate portion 112 (the reinforcing member 113).

Therefore, the electromagnetic wave radiated from the antenna cable 154 to adversely affect on the operation of the scanner portion 60 similarly to the electromagnetic wave of the antenna portion 150 can be shielded to ensure the operation of the scanner portion 60.

The laser printer 1 is provided with the metal reinforcing member 113, which has a substantially U-shaped section and which extends substantially in the horizontal direction from the first side plate portion 110 to the second side plate portion 111. Therefore, the mechanical strength (rigidity) of the gate-like frame constructed by the first and second side plate portions 110, 111 and the top plate portion 112 can be enhanced by the reinforcing member 113 to further suppress generation of a mechanical distortion in the image forming portion 10 by enhancing.

The antenna portion 150 is disposed at a location offset toward the signal processing board 153 from the center between the first and second side plate portions 110, 111 in the horizontal direction. Therefore, the length of the antenna cable 154 from the antenna portion 150 to the signal processing board 153 can be shortened, to thereby reduce the electrical noise emitted from the antenna cable 154 and adversely affected on the scanner portion 60.

Since the gate-like frame is constructed by the first and second side plate portions 110, 111 and the top plate portion 112, the process casing 75 in which the developer cartridges 74 are removably mounted cannot be attached to and detached from the laser printer 1 via the upper surface side thereof. If an attachment/detachment port is provided to the top plate portion 112 to enable attachment and detachment of the process casing 75 via the upper surface side of the laser printer 1, the mechanical strength of the gate-like frame constructed by the first and second side plate portions 110, 111 and the top plate portion 112 is largely reduced.

For this reason, the attachment/detachment port 115A of the laser printer 1 is provided at another location, namely, a front portion of the laser printer 1 to enable the attachment and detachment of the process casing 75 including the developer cartridges 74 therethrough without reducing the mechanical strength of the gate-like frame constructed by the first and second side plate portions 110, 111 and the top plate portion 112.

As described above, if the image forming portion 10 such as the photoconductive drum 71 is mechanically distorted, the quality of an image formed on a sheet is deteriorated. In particular, the reduction of image quality caused due to the mechanical distortion remarkably appears in a case of the so-called tandem type image forming apparatus in which plural photoconductive drums 71 are arranged in series along the sheet conveying direction. Therefore, like the laser printer 1, the present invention is effectively applicable to the tandem type image forming apparatus to provide significant advantages.

According to the above embodiments, as one of advantages, an adverse influence on an exposure unit operation by an electromagnetic wave radiated from the antenna portion can be remarkably reduced.

As another one of the advantages, an excellent radio communication substantially omni-directionally throughout 360° can be achieved.

OTHER EXAMPLES

As discussed above, the laser printer 1 is an example of the image forming apparatus according to the present invention when applied to the tandem type image forming apparatus. The application of the present invention is not limited to this example. Further, he present invention can also be applied to a four-cycle type laser printer, a monochromatic laser printer, and the like. Moreover, the present invention can also be applied to a printer of a type in which an LED array is used to form a latent image on a photoconductor drum.

In the laser printer 1, the first side plate portion 110 and the second side plate portion 111 are constructed to have the first frame 106 and the second frame 107 made of resin, but the present invention is not limited to this construction. For example, the first frame 106 and the second frame 107 may be made by the die casting (made of a metal).

In the laser printer 1, the signal processing board 153 is arranged on the first side plate portion 110, but the present invention is not limited to this arrangement. For example, the signal processing board 153 may be arranged on the second side plate portion 111.

In the laser printer 1, the reinforcing member 113 is provided to the top plate portion 112, but the present invention is not limited to this arrangement. For example, the reinforcing member 113 may be dispensed with.

In the laser printer 1, the first to fifth plates 101 to 105 are joined and fixed indirectly via the fist frame 106 and the second frame 107, but the present invention is not limited to this mode. These plates may be joined and fixed directly.

Also, the present invention is not limited to the above-noted examples. The invention may be embodied in other ways without departing from the scope of the invention defined by claims.

What is claimed is:

1. An image forming apparatus, comprising:

an image forming portion including a photoconductor that carries a developer image to be transferred onto a recording sheet, and an exposure unit that exposes the photoconductor;

a first side plate portion and a second side plate portion arranged on respective sides of the image forming portion in a horizontal direction to oppose to each other, the first and second side plate portions supporting the image forming portion and extending in a substantially vertical direction;

a metal top plate portion fixed to the first side plate portion and the second side plate portion so that the top plate portion extends in the horizontal direction to connect an upper end side of the first side plate portion and an upper end side of the second side plate portion and covers an upper side of the exposure unit;

an antenna portion for radio communication, disposed on a top side of the top plate portion; and a discharge tray on which the recording sheet is placed after the recording sheet is printed and discharged, wherein the first side plate portion and the second side plate portion are constructed to have metal plates, respectively, wherein the first and second side plate portions are fixed to the metal top plate to form a frame, and wherein the exposure unit, the metal top plate portion and the antenna portion are disposed to be superposed on each other in the vertical direction and an upper side of the antenna is covered by the discharge tray.

2. The image forming apparatus according to claim 1, further comprising:

a signal processing board disposed on one of the first side plate portion and the second side plate portion to process a radio signal; and an antenna cable connecting the antenna portion to the signal processing board;

wherein the antenna cable is disposed so that an electrical noise generated from the antenna cable is shielded by a plate of the first side plate portion, a plate of the second side plate portion and the top plate portion.

3. The image forming apparatus according to claim 2, wherein the top plate portion has a metal reinforcing member that has a substantially U-shaped section and that extends in the horizontal direction to extend between the first side plate portion side and the second side plate portion side, and at least a part of the antenna cable is accommodated within an internal space defined by the U-shaped section of the reinforcing member.

4. The image forming apparatus according to claim 2, wherein the antenna portion is disposed at a location offset toward the signal processing board from a center between the first side plate portion and the second side plate portion.

5. The image forming apparatus according to claim 1, further comprising:

a developer cartridge that contains therein a developer to be transferred onto the recording sheet and that is detachably attached to the apparatus in a space surrounded by the first side plate portion, the second side plate portion and the top plate portion; and an attachment/detachment port, through which the developer cartridge is configured to be attached to and detached from the apparatus, wherein the attachment/detachment portion is provided at an end of the space in a horizontal direction.

6. The image forming apparatus according to claim 1, wherein the photoconductor includes plural photoconductors that respectively correspond to plural colors and that are arranged in series along a conveying direction of the recording sheet.

* * * * *